US007156286B2

(12) United States Patent
Hengami

(10) Patent No.: US 7,156,286 B2
(45) Date of Patent: Jan. 2, 2007

(54) EFFICIENT PACKAGE DESIGN FOR POURABLE ITEMS

(76) Inventor: David Todjar Hengami, 4455 Torrance Blvd., #356, Torrance, CA (US) 90503

( * ) Notice: Subject to any disclaimer, the term of this patent is extended or adjusted under 35 U.S.C. 154(b) by 174 days.

(21) Appl. No.: 10/266,503

(22) Filed: Oct. 7, 2002

(65) Prior Publication Data

US 2004/0065723 A1 Apr. 8, 2004

(51) Int. Cl.
*B65D 43/20* (2006.01)

(52) U.S. Cl. ..... 229/125.12; 229/129.1; 229/220

(58) Field of Classification Search ..... 229/125.12, 229/129.1, 220
See application file for complete search history.

(56) References Cited

U.S. PATENT DOCUMENTS 1,543,953 A * 6/1925 Rothschild ..... 229/125.12
2,349,748 A * 5/1944 Otto ..... 229/220
2,507,430 A * 5/1950 Yancey ..... 229/220
2,903,175 A * 9/1959 Peimer ..... 229/220
2,950,851 A * 8/1960 Peimer ..... 229/220
3,040,953 A * 6/1962 Tindall ..... 229/220
4,094,456 A * 6/1978 Raccaforte ..... 229/131.1
4,201,329 A * 5/1980 Roccaforte ..... 229/131.1
5,505,373 A 4/1996 von Stillfried
6,116,499 A 9/2000 Todjar-Hengami
6,273,332 B1 8/2001 Todjar-Hengami
6,360,942 B1 3/2002 Todjar Hengami
6,393,707 B1 * 5/2002 Maffei ..... 33/1 SD
6,435,402 B1 8/2002 Hengami

* cited by examiner

*Primary Examiner*—Tri M. Mai
(74) *Attorney, Agent, or Firm*—Fulwider Patton LLP; Scott R. Hansen

(57) ABSTRACT

A blank for forming a tube type dispensing box having a top and a bottom, has a main box portion having two major sides and a minor side, each having a rectangular configuration. A second minor side is connected to one of the major sides by a fold line, the second minor side having a first opening at the top thereof. A slide retention member is foldably coupled to the second minor side, and has a second opening substantially aligned with the first opening when the slide retention member is folded over the second minor side. The blank further includes a slide opener secured by at least one tie to the slide retention member and by another tie to the second minor side, the slide opener including a third opening comparable in size to the first and second openings, and having an attachment portion for securing to the top of the box along an area spaced back from the second minor side.

3 Claims, 15 Drawing Sheets

42'
44a
48a
40
50
46
72a
56
58a
70a
20
54
22
18
60
30
14
48b
44b
68
72b
66
70b
62
80
64
46b
82
86
84
92
90
94
98
96
88
112
108
100
110
106
102
104
114
120
118
116
124
122
126
128

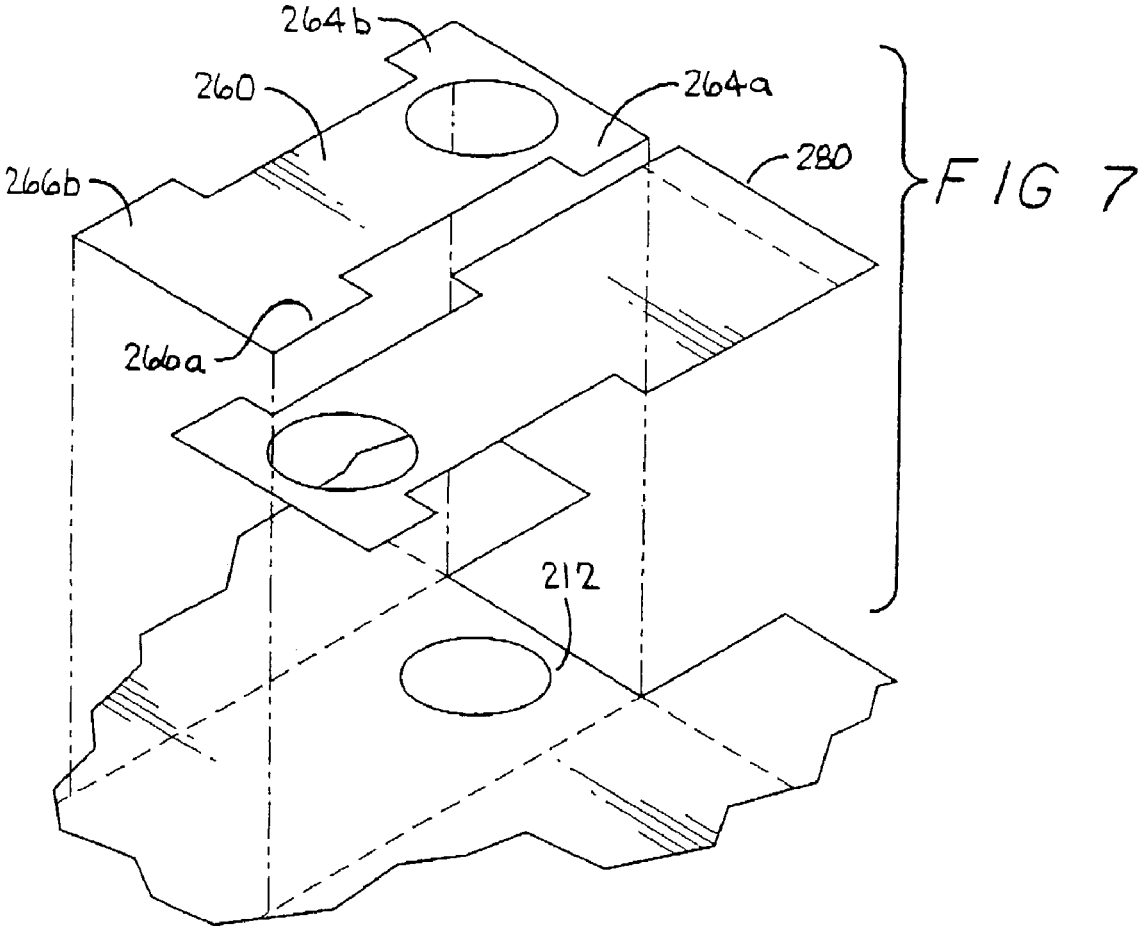
FIG 7
FIG 8
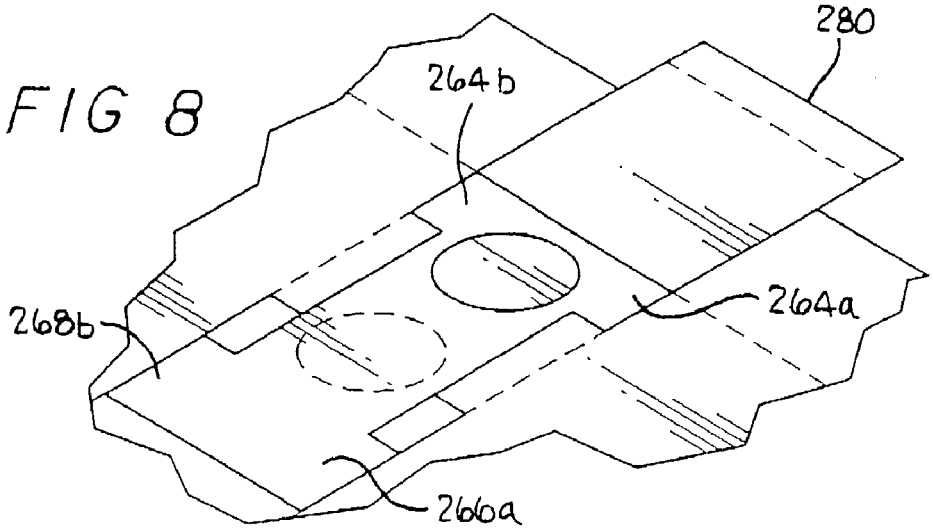

EFFICIENT PACKAGE DESIGN FOR POURABLE ITEMS

BACKGROUND OF THE INVENTION

1. Field of the Invention

The present invention relates to packaging pourable materials and, in particular, to a package blank for forming a box with a slide.

2. General Background and State of the Art

A wide range of pourable products, such as candies, cereals, laundry soaps, and many other products, are dispensed in cardboard boxes. To access the contents, a user must generally open the top of the box. Sometimes the contents are held in a wax paper bag inside the box, and the bag must be opened as well. To store the contents, the user closes the bag and then closes the box.

Designs of boxes and of re-sealable bags are disclosed in U.S. Pat. No. 6,435,402 ("Package design"), U.S. Pat. No. 6,360,942 ("Multiple compartment package design"), U.S. Pat. No. 6,273,332 ("Package design"), U.S. Pat. No. 6,116,499 ("Package design"), and U.S. Pat. No. 5,505,373 ("Folding package"), all of which are incorporated by reference herein.

In manufacturing the box, it is preferable that the box be such that it can be delivered to the end-manufacturer as a "tube box," which refers to a box that is partially assembled but that is collapsed. Automated machinery at the end-user uncollapses the "tube," then folds and secures top or bottom flaps to form a box with an open end. The machinery can then fill the box with a pourable product, or a bag filled with a pourable product.

U.S. Pat. No. 5,505,373 discloses a box for conveniently storing and dispensing pourable items. The box has a back wall and a slide connected to the back wall. The slide has a slide opening and two side tabs extending from the slide. A front wall with an opening is connected to the back wall. The box also has an interior supporting wall having first and second side slits. The slide is disposed within the box, with each of the tabs being inserted into a corresponding one of the slits. The box has an open position in which the openings are aligned and in which the contents of the box may be poured out. The box also has a closed position for storing the contents.

It is desirable to provide a box that can be manufactured and provided as a "tube," that also has a slide mechanism for opening and closing the box.

INVENTION SUMMARY

In one embodiment of a blank for forming a tube type dispensing box having a top and a bottom, the blank has a main box portion having two major sides and a minor side, each having a rectangular configuration. A second minor side is connected to one of the major sides by a fold line, the second minor side having a first opening at the top thereof. A slide retention member is foldably coupled to the second minor side, and has a second opening substantially aligned with the first opening when the slide retention member is folded over the second minor side. The blank further includes a slide opener secured by at least one tie to the slide retention member and to the second minor side, the slide opener including a third opening comparable in size to the first and second openings, and having an attachment portion for securing to the top of the box along an area spaced back from the second minor side.

According to another aspect of the invention, a blank for forming a tube type dispensing box has a main box portion having two major sides and one minor side each of full rectangular configuration. A second minor side is connected to one of the major sides by a fold line, the second minor side having a first opening at the top thereof. Slide retention arrangements are mounted to the second minor side, and providing a second opening substantially aligned with the first opening. The blank further includes a slide opener having third opening comparable in size to the first and second openings, and having an attachment portion for securing to the top of the box along an area spaced back from the second minor side. The blank has top and bottom flaps for sealing the box in a conventional tube box configuration.

According to another aspect of the invention, a blank for forming a tube type dispensing box comprises a first pair of opposing sides and a second pair of opposing sides, with both of the first pair and one of the second pair of sides being of full rectangular configuration. The other one of the second pair of sides has a first opening near the top thereof. The blank further includes a slide opener having a second opening comparable in size to the first opening, and having an attachment portion for securing to the top of the box along an area spaced back from the side having the opening therein. The blank has top and bottom flaps for sealing the box in a conventional tube box configuration. The slide retention arrangements comprise two narrow strips, one on each side of the first opening. The other one of the second pair of sides has at least one additional opening near the top thereof.

According to another embodiment, a tube style box has first, second, third and fourth sides, one of the sides having a side opening. The box has upper and lower flaps, and means for opening and closing the side opening. The box may include means within the box for retaining the means for opening and closing said side opening. The means for opening and closing may be a slide having an opening. The box may further include a retention member mounted within the box on a side wall of the box.

The retention member has an opening in alignment with the side opening. The retention member may include a slide member that is mounted on the top of the box. One of the sides includes a second side opening, and the box may include means for opening and closing the second side opening. One of the sides may include second and third side openings, and the box may include means for independently opening and closing the first, second and third side openings.

Embodiments of the invention may further comprise means for forming multiple compartments within the box. The box may, for example, also include means for forming three separate compartments within the box. Such means may include panel members that are folded over from a side of a box blank to form the multiple compartments. One or more of the panel members may include an aperture, which will align with the aperture in the side of the box to form a box opening.

Various other aspects of the invention will be recognized from studying the Detailed Description, the Drawings and the claims. Consequently, the invention is not limited to specifics that are disclosed in this Summary.

BRIEF DESCRIPTION OF THE DRAWINGS

FIG. 7 illustrates a first step in assembling the slider mechanism illustrated in FIG. 6;

FIG. 8 illustrates the assembled slider mechanism of FIG. 7;

DETAILED DESCRIPTION OF THE PREFERRED EMBODIMENTS

Figure 1:
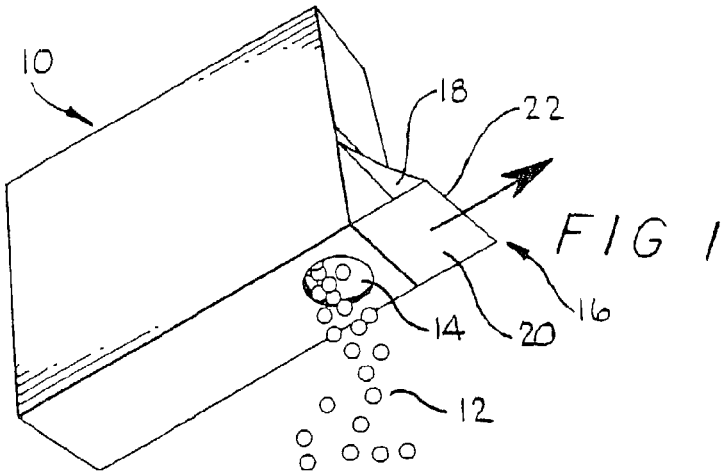
FIG. 1 is a perspective view of a box having an opening and a slide that opens and closes the opening.

FIG. 1 illustrates a package 10 having an opening 14. A slider mechanism 16 includes a lifting flap 18 and a slider 20 that are coupled together along a fold line 22. The lifting flap 18 can be lifted up to open the opening 14, or, relative to the position in FIG. 1, can be pushed downward to close the opening 14.

Figure 2:
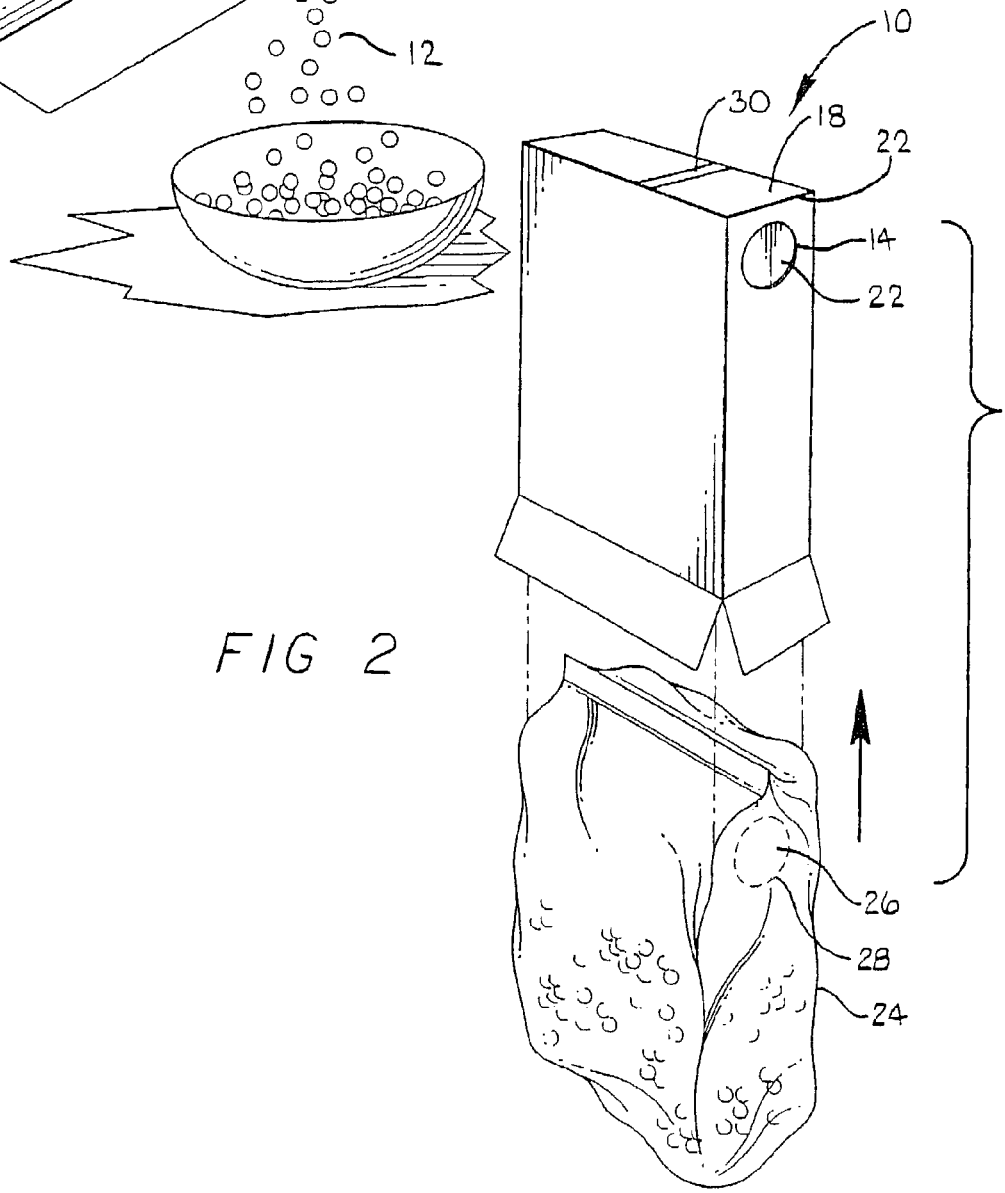
FIG. 2 is a view of the package of FIG. 1, with the bottom open to receive a bag filled with a pourable item.

The package 10 stores pourable items such as cereal 12, or any of a variety of items that can be poured. The pourable items may be stored directly in the box 10, or may be stored within a bag such as bag 24 in FIG. 2. As described in U.S. Pat. No. 6,116,499, issued on Sep. 12, 2000 to David Todjar Hengami, the bag 24 may include a removable portion 26 defined by lines of weakness 28. The removable portion 26 may be removed by the user prior to use, so that the contents of the bag 24 may be poured out. The bag 24 may be inserted into the package 10 through an open bottom as illustrated in FIG. 2, prior to the bottom being sealed. The bottom is typically sealed by gluing the various bottom flaps together after the box 10 is filled with the pourable material. The lifting flap 18 is secured to the top portion of the box at attachment portion 30, which is typically glued in place.

FIG. 2 illustrates the opening 14 being blocked by the slider 20 to put the package 10 in a closed position. This contrasts with FIG. 1, in which the lifting flap 18 is raised so that the slider 20 is moved upward to open the opening 14. In fact, the slider 20 includes an aperture that will be discussed in conjunction with FIG. 3, that comes into alignment with aperture 14 to allow contents of the box to be poured. This manner of aligning an aperture in a slide member with an aperture in the package member is described in U.S. Pat. No. 5,505,373 issued to von Stillfreid on Apr. 9, 1996, which is hereby incorporated by reference.

Figure 3:
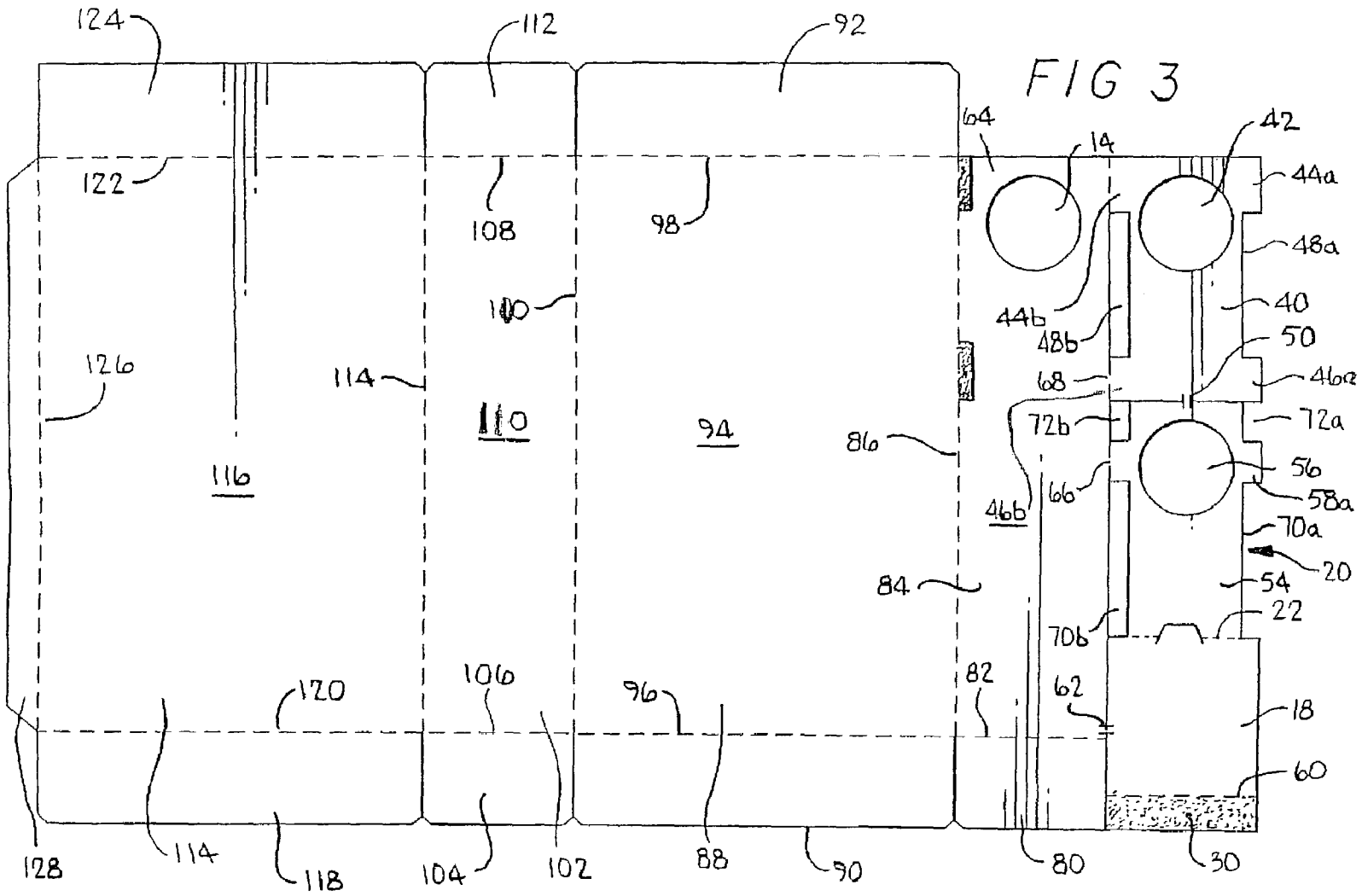
FIG. 3 is a box blank for forming the package of FIG. 1.

FIG. 3 illustrates a die-cut box blank that may be used to form the package 10. The blank includes a slider retention portion 40 having an aperture 42. The slider retention portion 40 includes stopper tabs 44A and 44B, as well as stopper tabs 46A and 46B. Stopper openings 48A and 48B are formed on either side of the slider retention portion 40.

The slider retention portion 40 is attached to the slider 20 by tie 50. The tie 50 may be a small portion that interconnects the slider retention portion 40 with the slider 20, but that is easily broken when desired. The slider 20 includes a neck 54 and an aperture 56, which corresponds generally in shape to the aperture 42 although not necessarily precisely the same. The neck 54 also includes stopper tabs 58A and 58B. The slider neck 54 is foldably interconnected with the lifting flap 18 along fold line 22. The fold line 22 is typically a square line, but may alternatively be another line of weakness. The lifting flap 18 is foldably interconnected with the attachment portion 30 by a fold line 60. A tie 62 separates the lifting flap 18 from a minor side 64. The stopper tab 58B is also interconnected with minor side 64 by a tie 66. Another tie 68 interconnects the slider retention portion 40 with the minor side 64.

The stopper tab 58B is defined on the one side by a cut-out 70B and on the other side by another cut-out 72B. Additional cut-outs 72A and 70A define the stopper tab 58A.

The minor side 64 includes the aperture 14, as well as a minor bottom dust flap 80. The minor bottom dust flap 80 is defined by a fold line 82 between the minor bottom dust flap 80 and the main minor side portion 84. A further fold line 86 foldably interconnects the minor side 64 with the major side 88. The major side 88 includes a major bottom dust flap 90 and a major top dust flap 92. The major bottom dust flap 90 is foldably interconnected with the main body portion 94 by fold line 96. An additional fold line 98 foldably interconnects the main body portion 94 with the major top dust flap 92.

A fold line 100 foldably interconnects the major side 88 with a second minor side 102. A minor bottom dust flap 104 is foldably interconnected with the main body portion by fold line 106. An additional fold line 108 foldably interconnects the main body portion 110 with the minor dust top flap 112.

An additional fold line 114 foldably interconnects the main body portion 110 of the second minor side 102 to a major side 114. The second major side 114 includes a main body portion 116, which is foldably interconnected with the major bottom dust flap 118 by fold line 120. An additional fold line 122 foldably interconnects the main body portion 116 with a major dust flap 124. A fold line 126 foldably interconnects the main body portion 116 with an overlapping flap 128. The blank illustrated in FIG. 3 may be folded and secured into a box 10, as illustrated in FIG. 1.

Figure 3A:
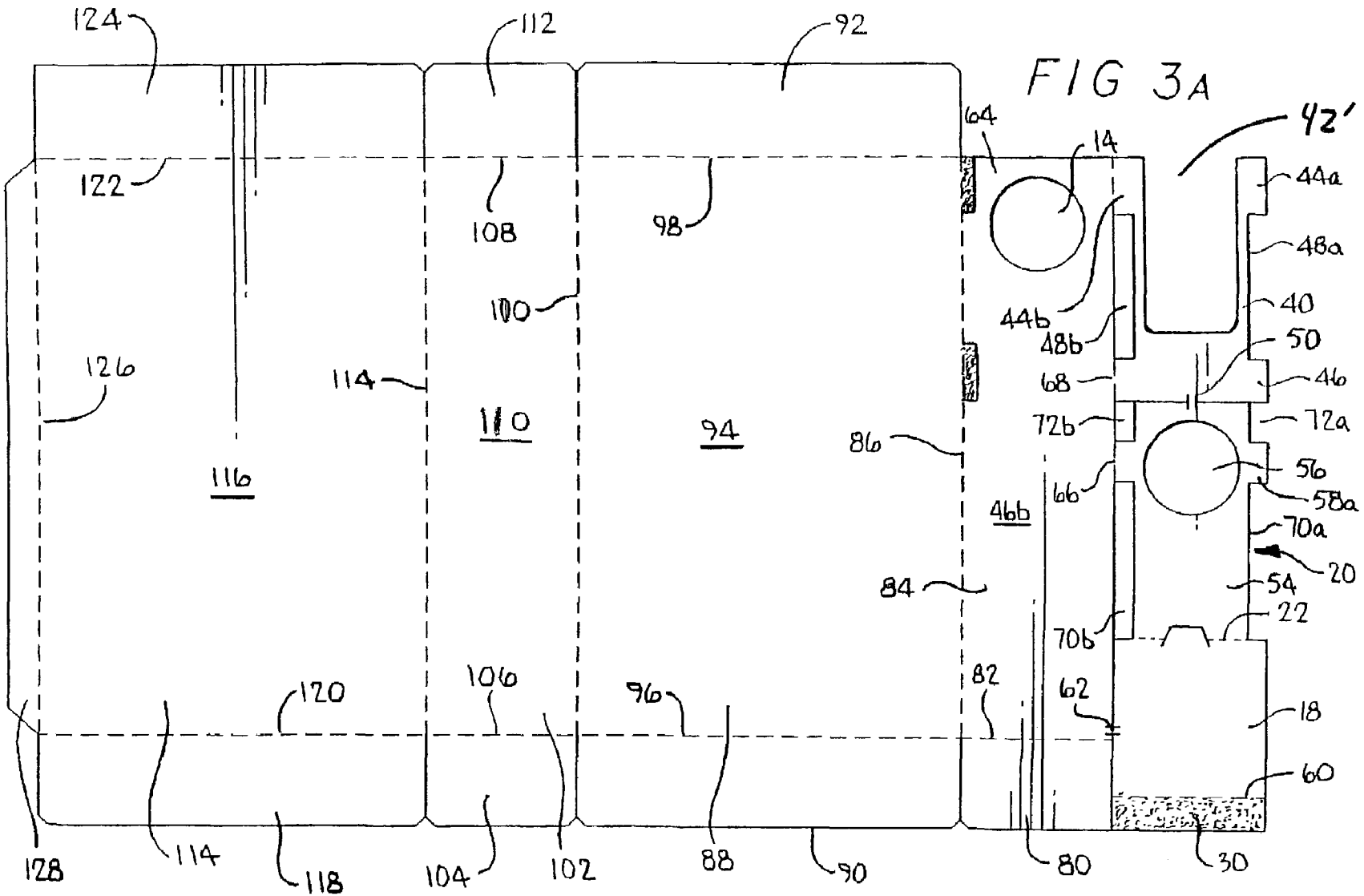
FIG. 3A is an alternative version of FIG. 3, in which an elongated opening substitutes for a round opening.

FIG. 3A is an alternative version of the blank of FIG. 3, in which the aperture 42' is elongated rather than round. The opening 42' may be of any of a variety of different shapes, so long as apertures 14, 42' and 56 align in the open position to provide a pathway from the interior of the package to the exterior.

Figure 5:
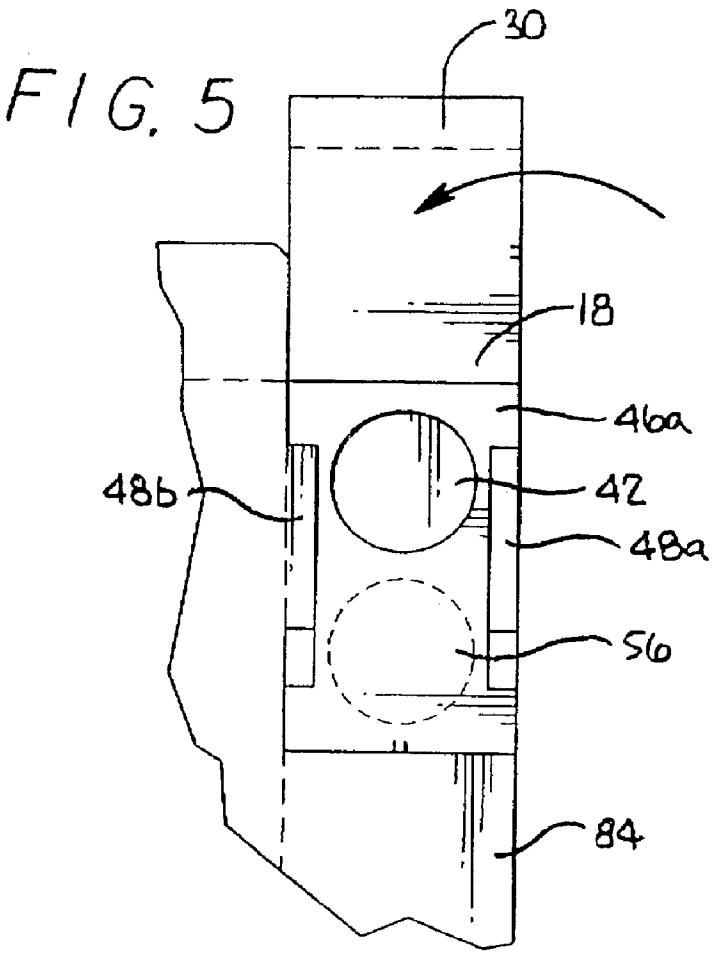
FIG. 5 is a second step in forming a slider mechanism from the box blank of FIG. 1.
Figure 4:
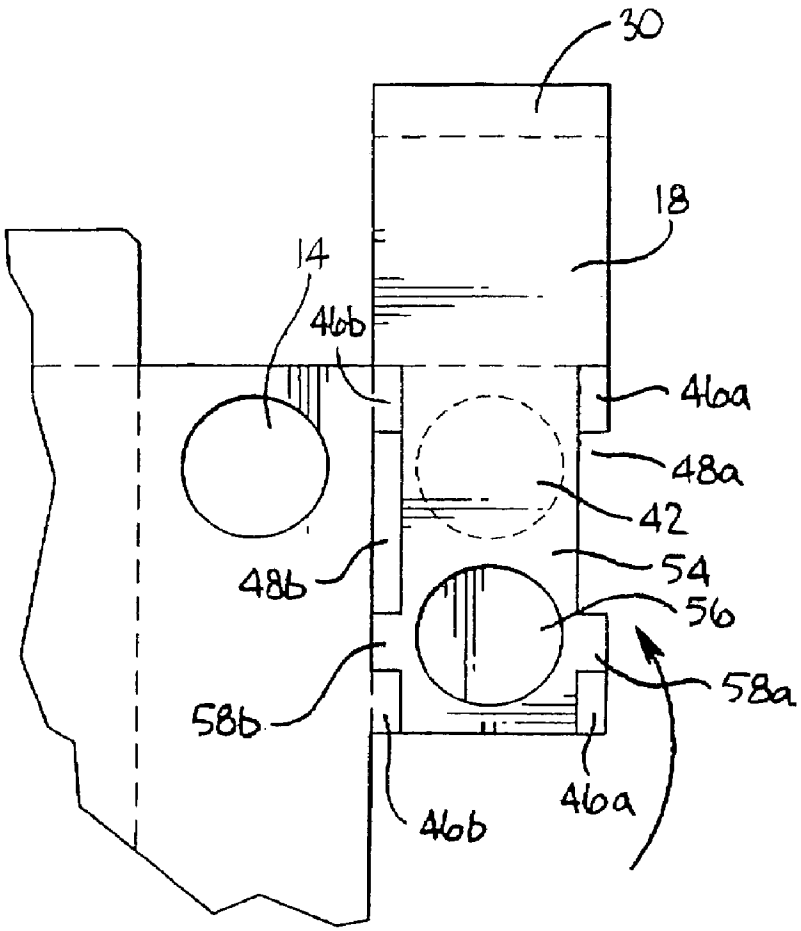
FIG. 4 is illustrates a first step in forming a slider mechanism from the box blank of FIG. 1.

FIG. 4 illustrates a first step in forming a slider mechanism from the blank of FIG. 3. The lower portion of the slider mechanism that includes the lifting flap 18 is folded upward onto the slider retention portion 40. Then, as FIG. 5 illustrates, the mechanism is folded over onto the first minor side 64. The stopper tabs 46A and 46B, as well as stopper tabs 44A and 44B, may be glued onto the minor side 64 to secure the sliding mechanism into place. The remainder of the box blank may be then folded and secured into the configuration of box 10 in FIG. 1. The overlapping flap 128 in FIG. 3 may be glued or otherwise adhered to the minor side 64 to secure the box into place. The attachment portion 30 of the slider mechanism may be glued or otherwise adhered to the top of the box to anchor the slider mechanism into place. When the lifting flap 18 is first lifted upward, the tie 50 is broken and the slider neck 54 is free to slide up and down along the minor side of the box 64. The stopper tabs 44A and 44B limit the upward movement of the slider member 54, as the stopper tabs 58A and 58B are prevented by stopper tabs 44A and 44B from advancing upwardly out of the box.

Alternatively, the tie may be broken in advance, before the slider is mounted into position. relative to the slider retention member.

It should be understood that the apertures 14, 42 and 56 are all compatible in shape, such that when the three openings are aligned, a path is formed from the interior of the package to the exterior. The contents on the interior of the package may then be poured out the apertures when they are aligned. The apertures 14, 42 and 56 are not necessarily the same shape, however. It is only important that the shapes are compatible in the manner described.

Figure 6:
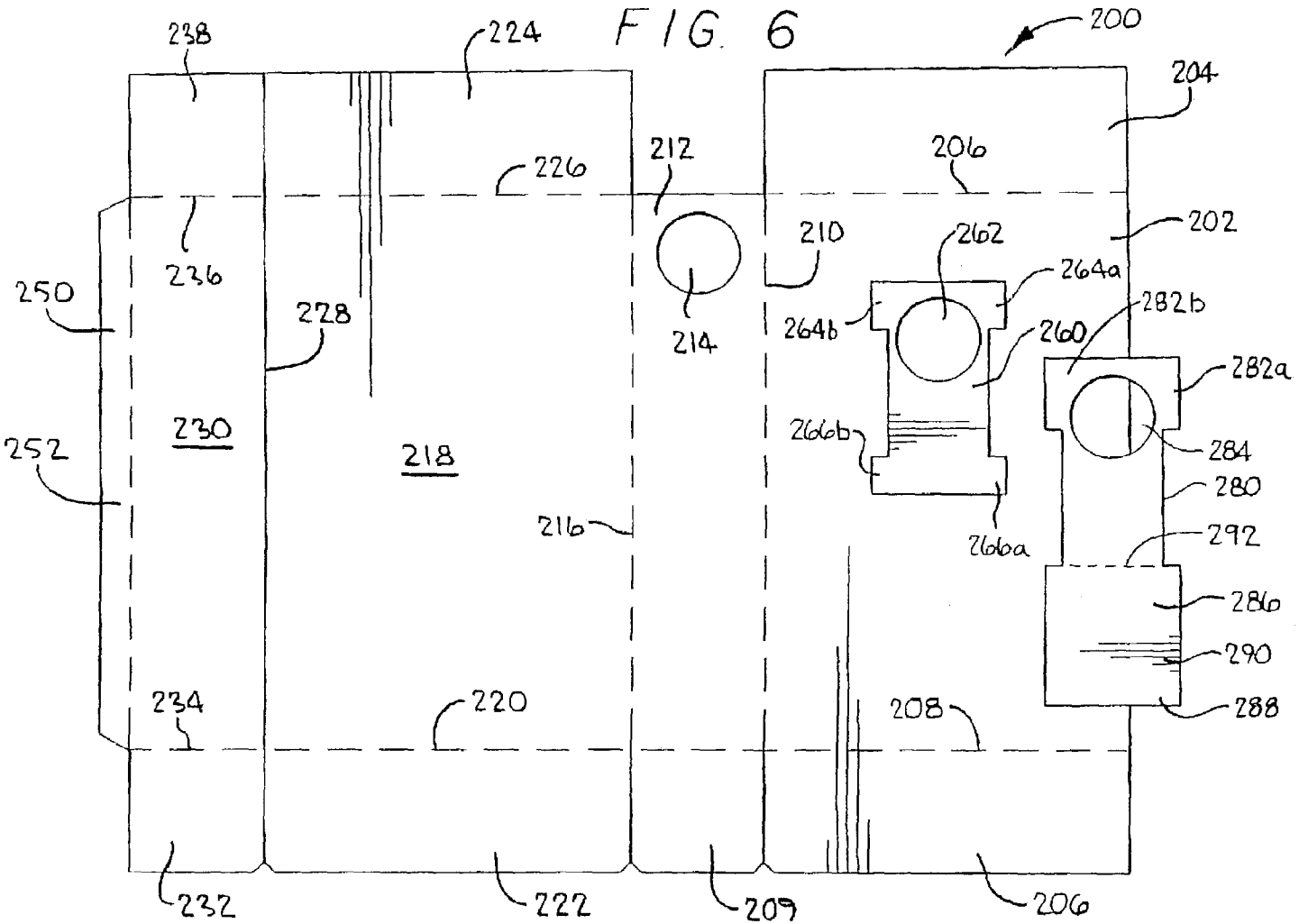
FIG. 6 is an alternative blank for forming a box, with the slider mechanism provided separately from the box blank.

FIG. 6 illustrates an alternative box blank embodiment. In this embodiment, a slider mechanism is provided into separate, independent pieces. These pieces are not necessarily part of the larger box blank. The box blank 200 includes a first major side 202 having a top flap 204 and a bottom flap 206. The top flap 204 is foldably attached to the first major side 202 by fold line 206. The bottom flap 206 is foldably connected with the main body portion of the first major side 202 by fold line 208. The first major side 202 is foldably interconnected along fold line 210 with the first minor side 212. The first minor side 212 includes an aperture 214 and a first minor side bottom flap 209. The first minor side 212 is foldably interconnected along fold line 216 with the second major side 218. The second major side 218 is foldably interconnected along fold line 220 with the second major side bottom flap 222. The main body portion of the second major side 218 is also foldably interconnected with a major top flap 224 along a fold line 226.

A further fold line 228 foldably interconnects the second major side 218 with a second minor side 230. A second minor side 230 includes a second minor side bottom flap 232 that is foldably interconnected with the main body portion of the second minor side 230 by fold line 234. An additional fold line 236 foldably interconnects the second minor side 230 with the second minor side top flap 238. An overlapping flap 250 is foldably interconnected with the second minor side 230 by a fold line 252.

The sliding mechanism includes a slider retention portion 260 having an aperture 262 and upper stopper flaps 264A and 264B, along with lower stopper flaps 266A and 266B. A slider member 280 includes upper slider members 282A and 282B, as well as an aperture 284. A lifting flap 286 is separated from an attachment portion 288 by a fold line 290. A fold line 292 foldably interconnects the lifting flap 286 with a neck portion of the slider member 294.

FIG. 7 illustrates the slider member 280 being applied to the minor side 212. The slider stopper mechanism 260 is put down atop the slider member 280 relative to FIG. 7. The slider stopper 260 is typically glued at stopper tabs 264A and 264B and at stopper tabs 266A and 266B. The slider unit then becomes as in FIG. 8, in which the slider member 280 may be slid upwardly and downwardly, as desired. The stopper tabs 264A and 264B will serve to prevent the slider member 280 from pulling out of the box, by limiting the distance that the slider tabs 282A and 282B can travel. That is the slider tabs 282A and 282B are stopped by the slider tabs 264A and 264B as the tabs 282A and 282B are pulled out of the box.

It should be understood that the two embodiments illustrated in the drawings may be pre-made into a tube-style box, in which the box is formed but collapsed, such that the upper tabs and lower tabs are not yet secured. That is, the blank is formed into a collapsed, partially constructed box. The tube may then be opened by standard machinery for forming boxes from box blank. The top flaps are then secured in place by the box machinery, and the attachment portion of the slider is affixed atop the box. The box is filled, either by inserting a bag filled with pourable material or by directly filling the box with pourable materials, such as cereal or another pourable item.

In particular, with reference to FIG. 6, the tube-style box would be formed by first constructing the slider mechanism as illustrated in FIGS. 7 and 8. Then, the box blank is folded along fold lines 210, 216, 228 and 252. The attachment portion 250 is secured to the exterior, or optionally the interior, of the first major side 202, by way of adhesive or other securing means. The box is collapsed, without having interconnected the top or bottom flaps. The collapsed box blank may then be provided to an end manufacturer to be uncollapsed, and formed into the package of FIG. 2. The box may be filled with pourable material or with a bag that is itself filled with a pourable material, such as cereal or another pourable item.

Figure 9:
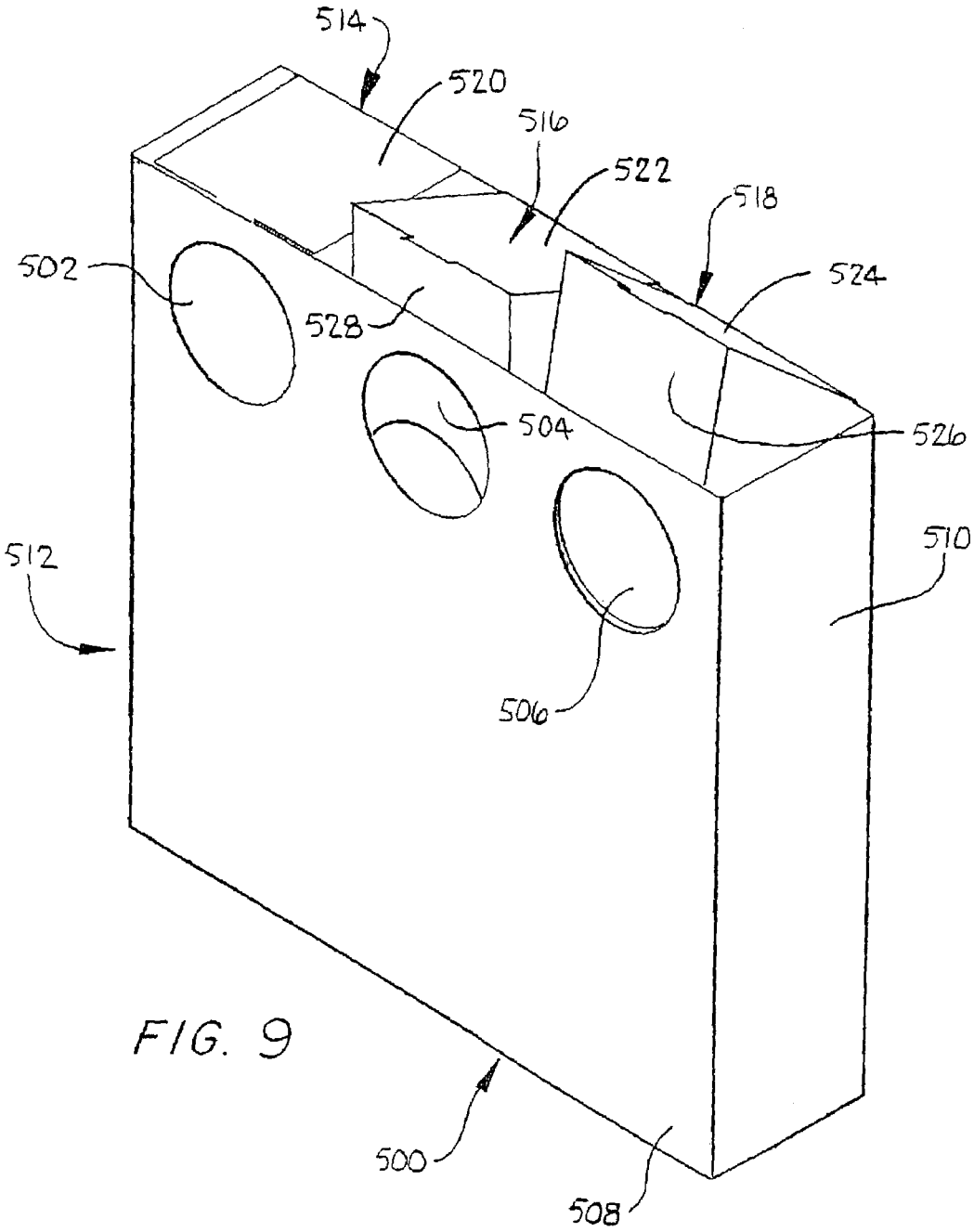
FIG. 9 is a perspective view of a multi-compartment package.

FIG. 9 illustrates a multi-compartment package embodiment 500 having a first, second and third opening, 502, 504 and 506, respectively. The box has a front 508, two sides 510 and 512, respectively, a back, a bottom, and a top. Three slide members serve to open and close the openings 502, 504, and 506. The slides 514, 516, and 518 include respective lifting flaps 520, 522, and 524. The lifting flaps are foldably interconnected with respective necks, such as 526, 528, and 530 (not shown). Each neck has a respective opening. When the lifting flaps are pulled upward, the opening of the lifting flaps aligns with an opening in the package, such that the contents of the package may be poured out the opening.

The opening 502 is shown as being blocked and therefore in a closed position. The opening 504 is shown as partially opened, such that the opening in the neck is partially aligned with the opening in the package. The opening 506 is shown as being completely opened, such that the opening in the neck 526 is perfectly aligned with the opening in the package 506. It should be noted that the openings in the respective neck portions may have the same shape as the opening in the package portions, or alternatively may be a different shape that is compatible with the shape of the respective package opening.

Figure 10:
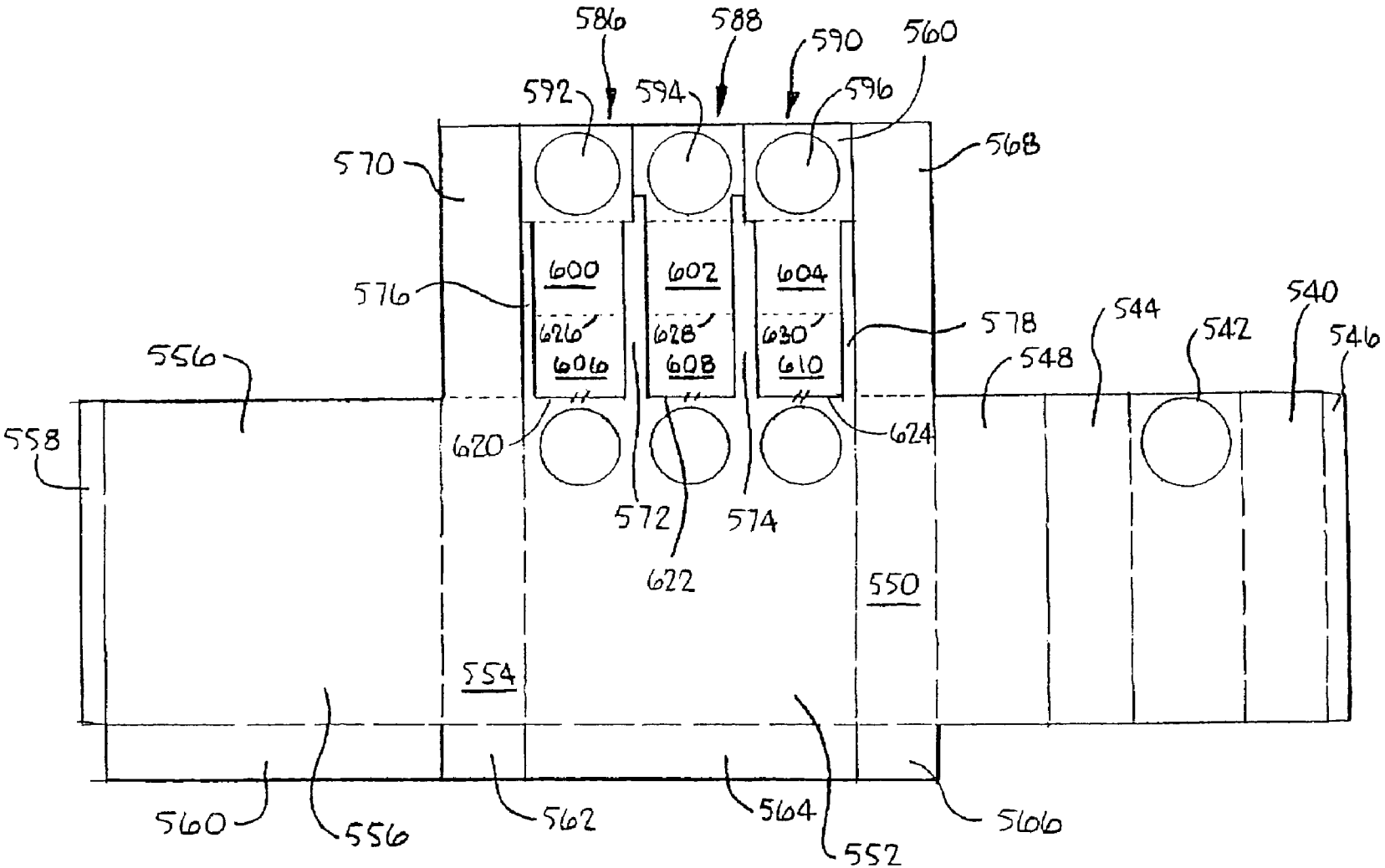
FIG. 10 is a blank from which the multi-compartment package of FIG. 9 is formed.

FIG. 10 illustrates a blank for forming the multi-compartment package of FIG. 9. The blank includes several compartment panels 540, 542, and 544. A connection panel 546 is typically coated with adhesive or glue and serves to secure the panels to the interior of the package. A minor side 550 is foldably interconnected with a major side 552, which in turn is foldably interconnected with a second minor side 554. A second major side 556 is foldably interconnected with the second minor side 554. The bottom of the box is defined by flaps 560, 562, 564 and 566. Extension 558 is typically glued or supplied with other adhesive for securing the box shut. The top 558 serves to define a portion of the top of the box, along with flap 570. Narrow strips 572 and 574, along with strips 576 and 578 are foldably interconnected with the major panel 552. The major panel 552 includes opening 580, 582, and 584.

Slide mechanisms 586, 588, and 590 are provided adjacent to the second major side 556. Each of the slides includes a respective slide opening 592, 594, and 596. The slides include respective neck portions 600, 602, and 604. The slides also include respective top flap portions 606, 608, and 610. The flaps 586, 588, and 590 are removably attached to the second major portion 556 along lines of weakness 620, 622, and 624, which may be perforations, one or more ties, or other line of weakness. Each slide includes a respective mid-fold line 626, 628, and 630.

Figure 11:
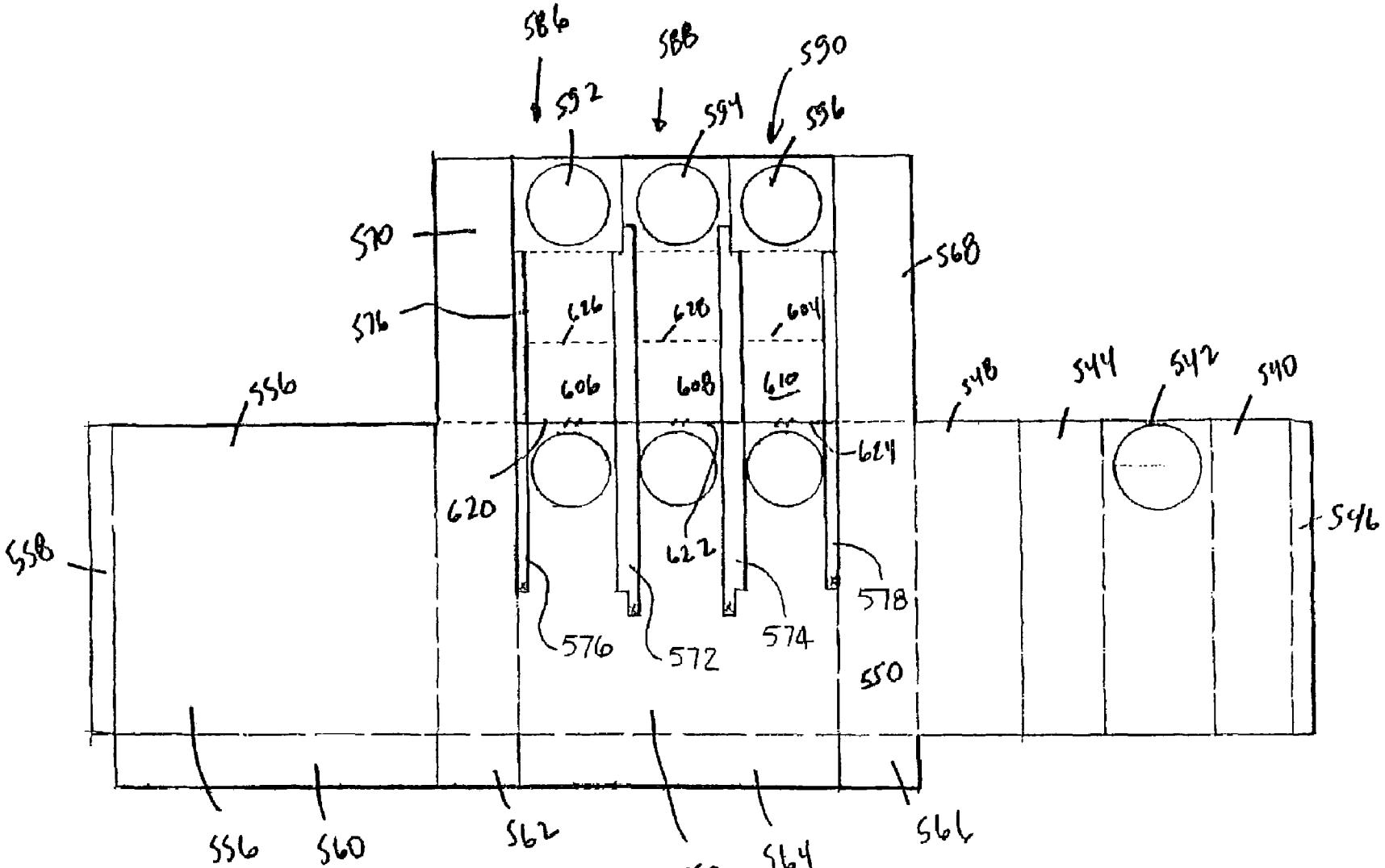
FIG. 11 illustrates folding down strips of FIG. 10.

FIG. 11 shows a first step in preparing the box. The respective hinge strips 572, 574, 576, and 578 are folded down into what will be the interior of the box.

Figure 12:
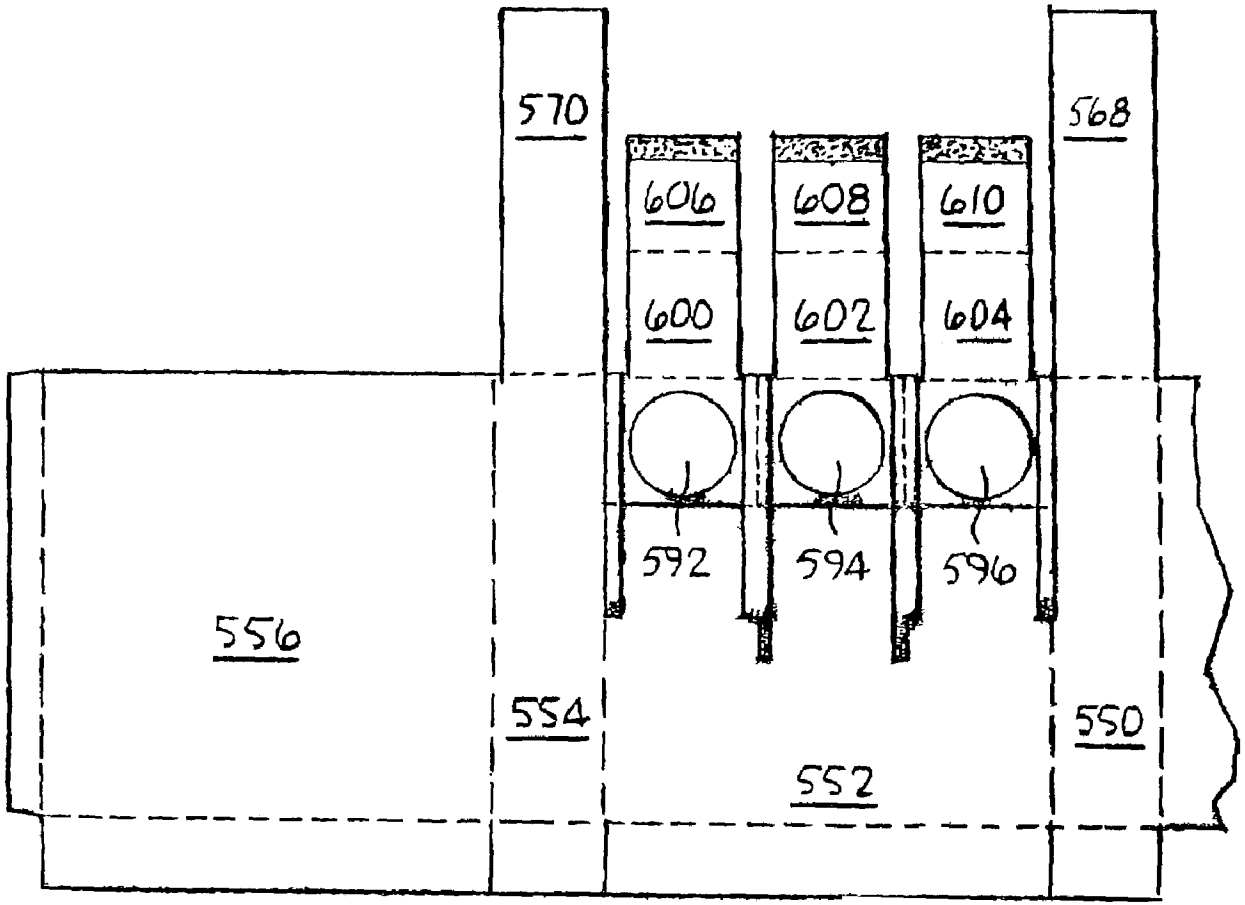
FIG. 12 illustrates loading the slides onto the box.

FIG. 12 illustrates a second step, in which the respective slide portions 586, 588, and 560 have been removed from the major side 556 and inserted within slots created by the narrow strips 572, 574, 576, and 578. The narrow strips may be secured to the interior of the package by, for example, gluing the stips into place.

Figure 12A:
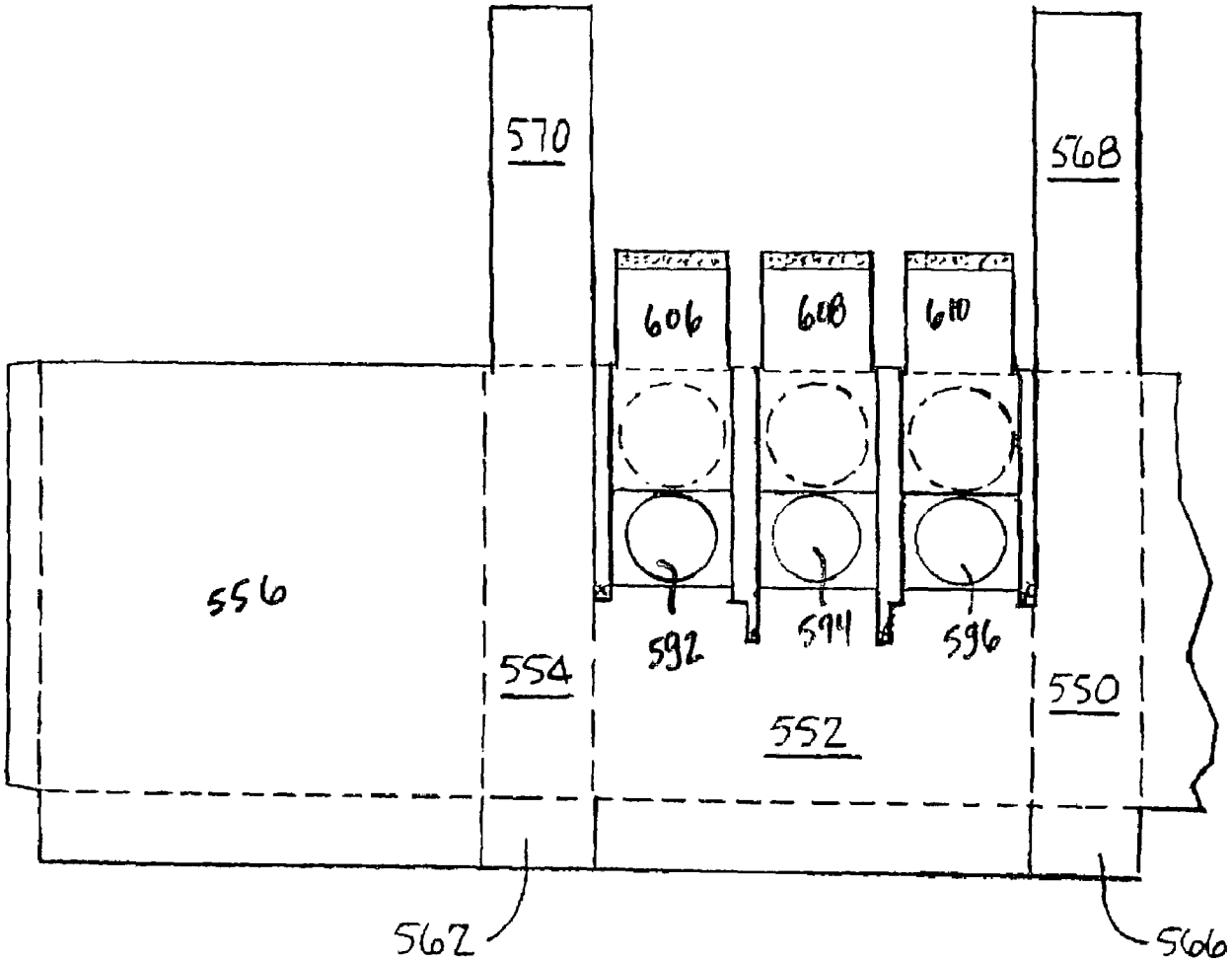
FIG. 12A illustrates the slides slid down into a "closed" position in which the slide opening does not align with the package opening.

In FIG. 12A, the slide portions are shown displaced from the "open" position of FIG. 12, in which the openings in the slide portions align with openings in the package. In FIG. 12A, by contrast, the slides are moved down such that the slide openings do not align with the openings in the package. Thus, the slides are free to move up and down within the slots created by the narrow strips 572, 574, 576 and 578.

Figure 14:
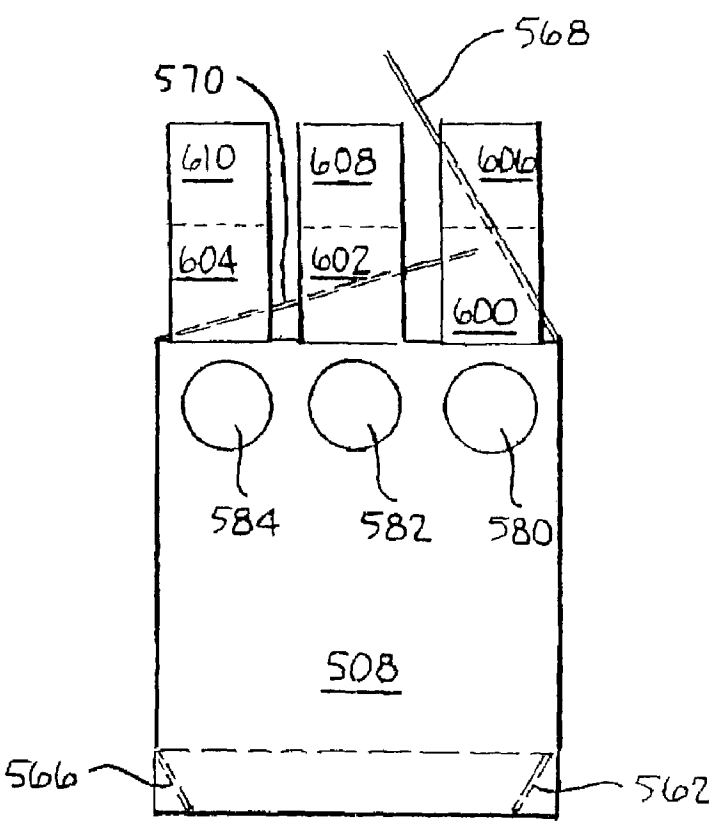
FIG. 14 illustrates a final step in constructing the box.
Figure 13:
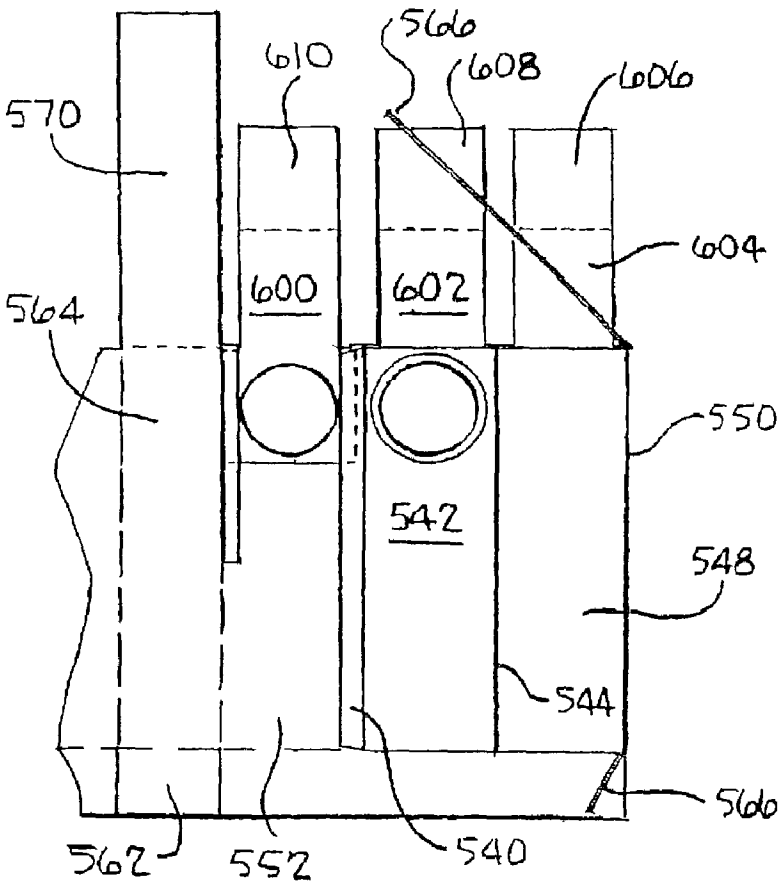
FIG. 13 illustrates a folding step.

Considering a further step in constructing the box, in FIG. 13 the box is further folded such that the respective compartment panels form individual compartments within the package. The compartment panels may be glued into place, or otherwise secured, to form the interior compartments. In FIG. 14, the two top flaps are folded downward to define the top of the box. The slides are secured to the box along the respective fold lines 620, 622, and 624. The slides are positioned such that they may be pulled up and down, to open and close the respective package openings, as the user desires.

Figure 15:
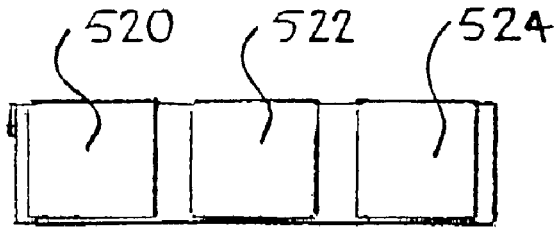
FIG. 15 is a top view illustrating the three slides atop the box.

FIG. 15 is a top view showing the top of the respective flaps. The flaps in FIG. 15 are in a down or closed position, such that the respective package openings are secured shut.

Figure 16:
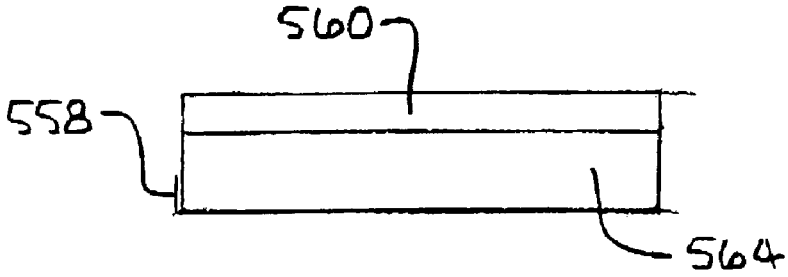
FIGS. 16 and 17 are side views of the constructed box of FIG. 10.
Figure 17:
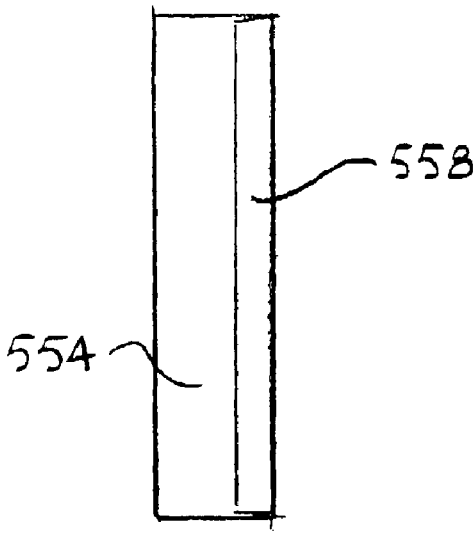

FIG. 16 is a view showing the package secured together. FIG. 17 illustrates the securing flap 558 having been secured onto the package by way of adhesive or other securing means, to secure the package into place.

Figure 18:
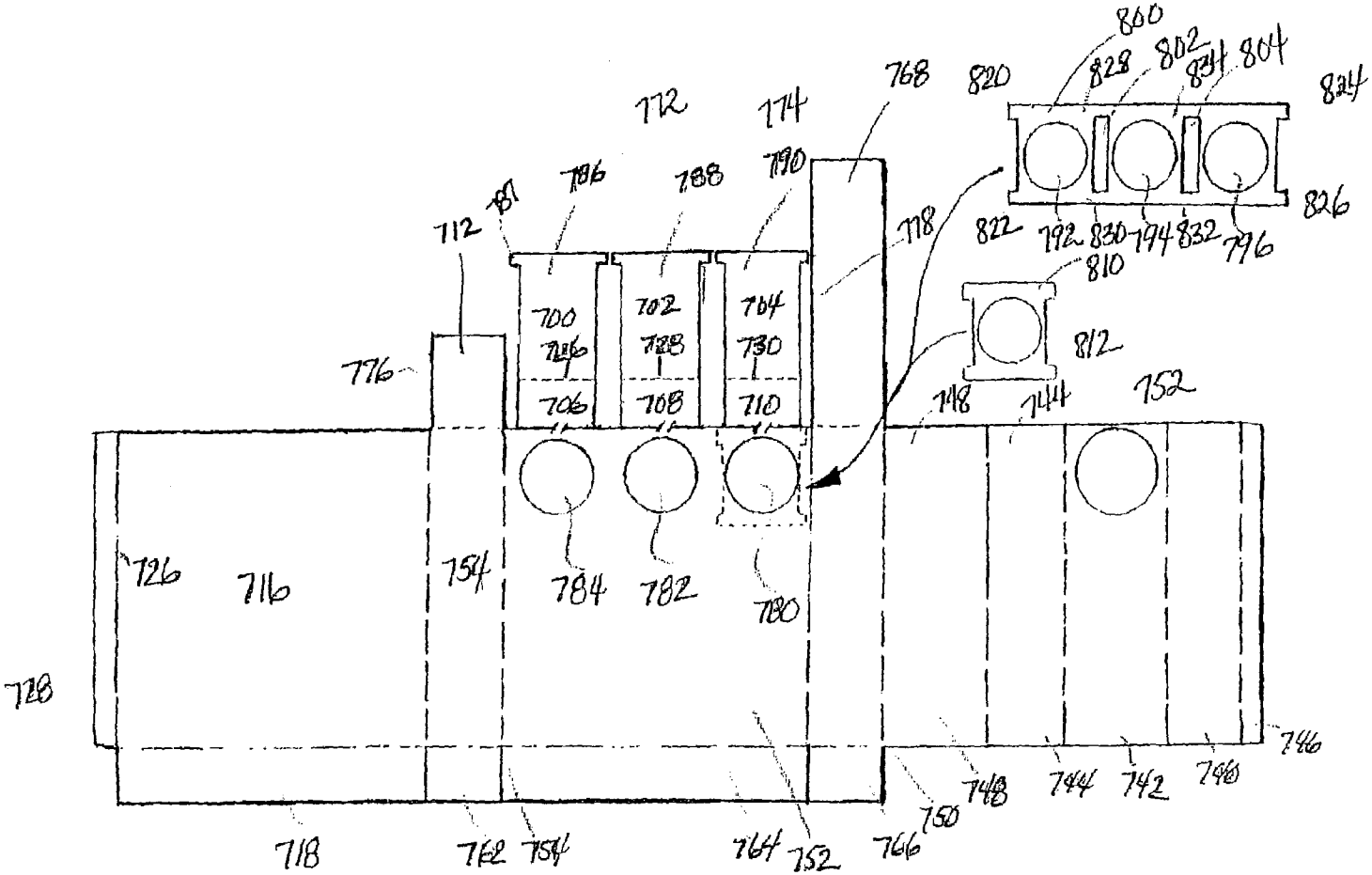
FIG. 18 is an alternative blank design for forming a multi-compartment package.

Considering now a further alternative, FIG. 18 illustrates a blank for forming a multi-compartment package. The various panels and flaps of the blank are generally numbered as in FIG. 11, but in the seven hundred series. In this embodiment, the slide retention members are provided to be mounted on the interior of the package, adjacent to the package openings. The retention members may be provided as an integral, removable part of the blank. Or, as in the embodiment of FIGS. 18 and 19, may be provided separately. As a further alternative, the retention members may be provided in a single unit 800 having multiple openings 792–796, or may be provided as multiple individual units such as 810 with one opening 812 each.

To install the retention members to the interior of the package, the ears of the slide retention members 820, 822, 824 and 826 are typically glued or are otherwise attached to the interior of the package, such that the openings 792, 794 and 796 of the slide retention members align with the openings 780, 782 and 784 of the package. The retention member 800 may also be glued or otherwise attached to the package at 828, 830, 832 and 834.

Each respective slide 786, 788, 790 has a single set of stopper ears, and a respective fold line 726, 728, 730 about which the respective slide may be folded. The slides do not include respective slide openings. The respective pairs of stopper ears may slide within the space defined by the slide retention members, to open and close the package. The ears of the slide retention members that are glued or otherwise attached to the interior of the package limit the range of motion of the respective slides. That is, the slides are not permitted to slide upwardly beyond the top edge of the box, or downwardly past the bottom of the slide retention members.

Figure 19:
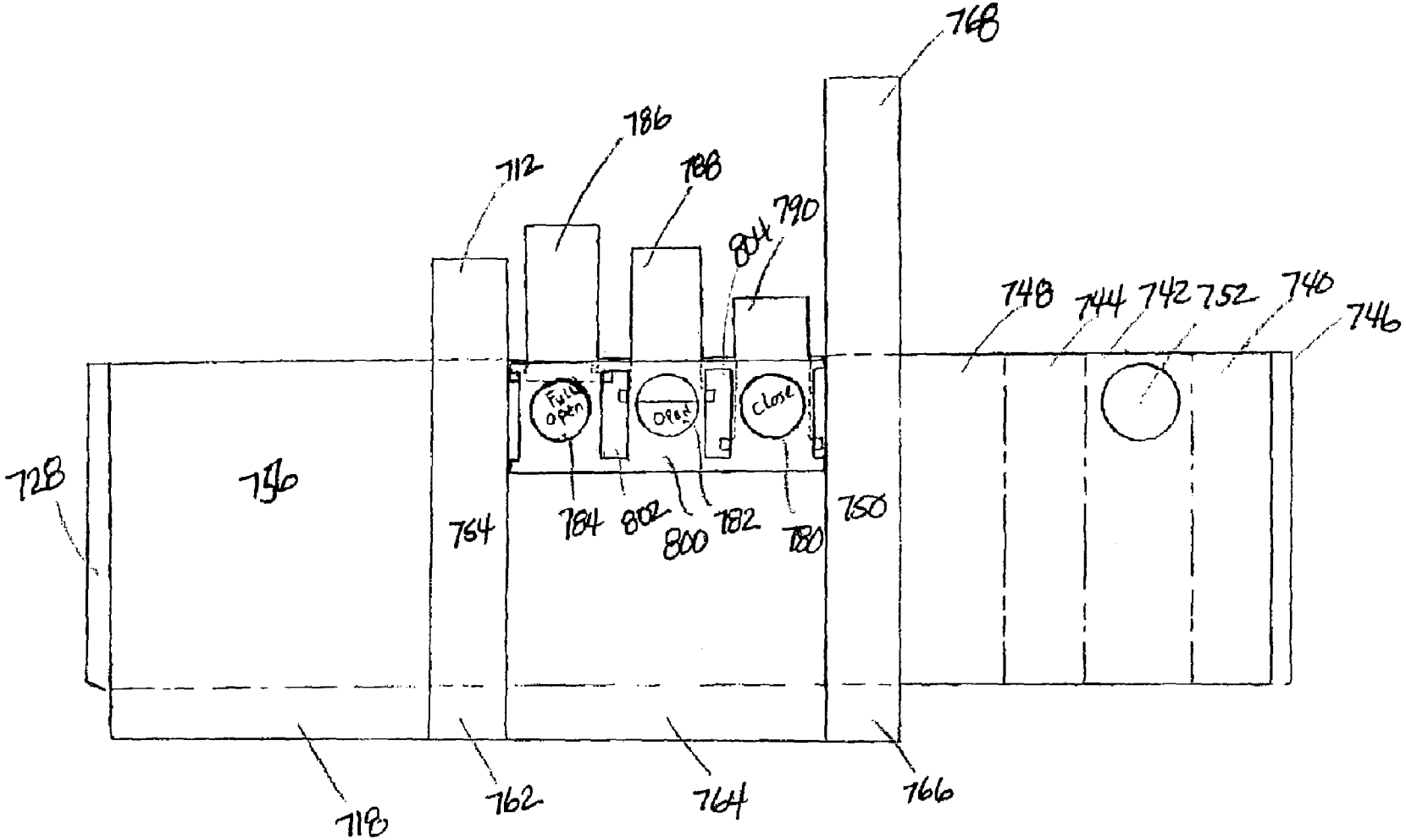
FIG. 19 is the blank of FIG. 18 with the slides engaged with the slide retention members.

The panels 742–748 fold to form interior walls of a multi-compartment package. In the embodiment of FIGS. 18 and 19, the package has three compartments, although embodiments may be formed having less than or more than three compartments in alternative embodiments.

The foregoing as described presently preferred embodiments of the invention. However, numerous variations and modifications may be made within the scope of the invention. Consequently the invention is defined by the claims and not by the details in this Detailed Description.

I claim:

1. A blank for forming a tube type dispensing box having a top and a bottom, comprising:

a main box portion having two major sides and one minor side, each of full rectangular configuration;

a second minor side connected to one of said major sides by a fold line, said second minor side having a first opening at the top thereof a slide retention member foldably coupled to said second minor side, and having a second opening substantially aligned with said first opening when said slide retention member is folded over said second minor side; and said blank further including a slide opener secured by at least one tie to said slide retention member, and secured by at least one slide member to said second minor side, said slide opener including a third opening comparable in size to said first and second openings, and having an attachment portion for securing to the top of said box along an area spaced back from said second minor side.

2. A blank as defined in claim 1, wherein the slide opener comprises a lifting flap and a slider, with a fold line in between the lifting flap and slider.

3. A blank for forming a tube-type box comprising:

first and second major sides;

first and second minor sides, said second minor side having an aperture;

a slider retention member foldably attached to the second minor side;

a slider member removably attached to the second minor side, said slider member being adjacent to said slider retention member;

said slider retention member comprising first and second stopper tabs and an aperture;

said slider member comprising a neck portion having an aperture, a lifting flap, and a fold line separating the neck portion and the lifting flap;

wherein said slider member is removable from said box blank, and said slider retention member is foldable onto said second minor side such that the aperture of said slider retention member aligns with the aperture of said second minor side.

* * * * *